United States Patent [19]

Ramer

[11] 4,105,160

[45] Aug. 8, 1978

[54] RAIL JOINT BAR FOR NON-UNIFORM RAILS

[76] Inventor: James LeRoy Ramer, Rte. 1, Box 155, Sullivan, Mo. 63080

[21] Appl. No.: 795,479

[22] Filed: May 10, 1977

[51] Int. Cl.[2] ..... E01B 11/16

[52] U.S. Cl. ..... 238/167; 238/130; 138/151; 238/177; 238/243; 238/267

[58] Field of Search ..... 238/130, 151, 167, 175, 238/177, 243, 267

[56] References Cited

U.S. PATENT DOCUMENTS

| | | | |
|---|---|---|---|
| 415,290 | 11/1889 | Curry et al. | 238/177 |
| 1,020,941 | 3/1912 | Allen | 238/167 |
| 1,260,150 | 3/1918 | Coughlin | 238/177 X |
| 1,731,110 | 10/1929 | Rogers | 238/130 X |
| 2,531,656 | 11/1950 | Thonger | 238/167 |
| 3,525,472 | 8/1970 | Sato | 238/175 X |

*Primary Examiner*—Randolph A. Reese
*Attorney, Agent, or Firm*—Thomas O. Maser

[57] ABSTRACT

A joint bar for joining a first rail having a head and a depending terminal web, and a second rail having a head, a depending web and a transverse flange; the joint bar has a first U-shaped portion with a lower bight and upstanding legs, and a second portion comprising a pair of spaced longitudinally extending elements, each extending from a leg of the first portion. Each element has an upper bulbous head, a lower flange, and a connecting web.

12 Claims, 5 Drawing Figures

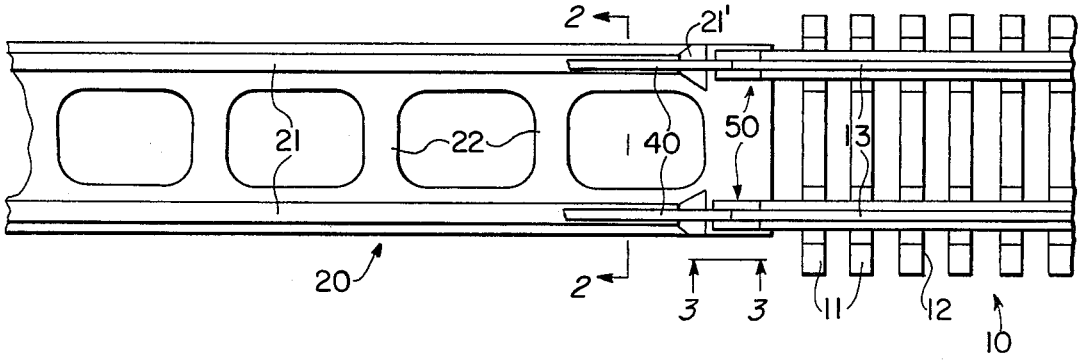
FIG. 1
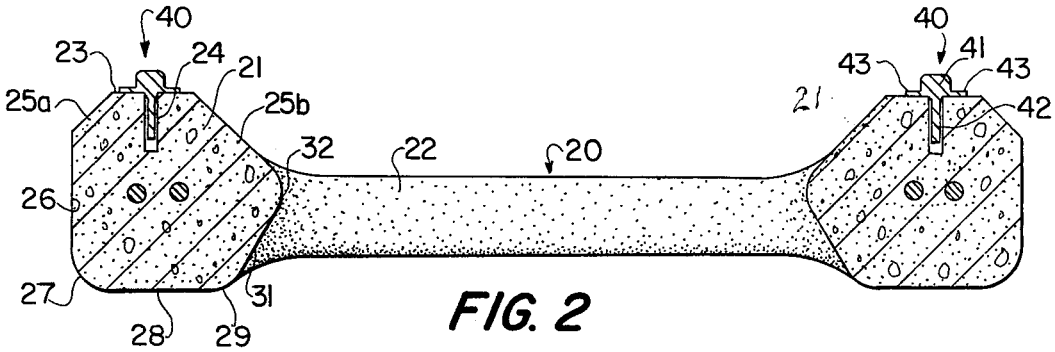
FIG. 2
FIG. 3
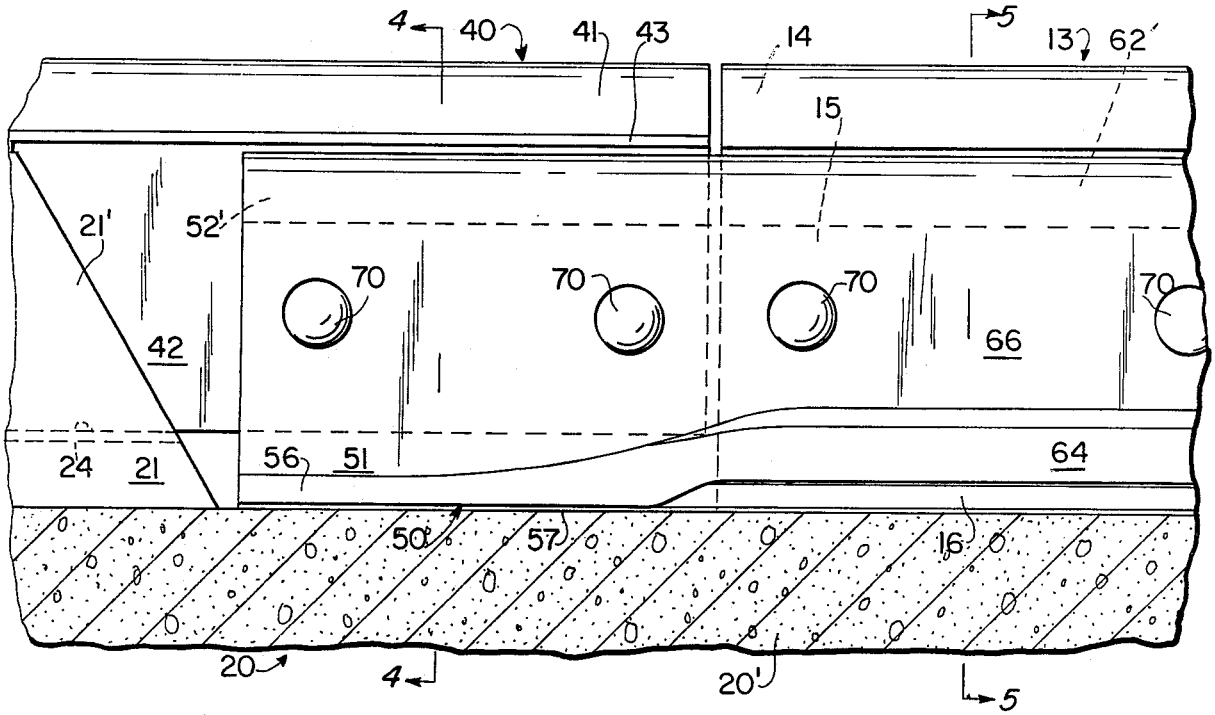

RAIL JOINT BAR FOR NON-UNIFORM RAILS

Cross-Reference to Related Application

This application in part discloses subject matter described in application Ser. No. 795,480, filed concurrently herewith by James L. Ramer entitled Concrete Railroad Bed, Rail and Method.

BACKGROUND OF THE INVENTION

There has been disclosed in the above referenced application a concrete track bed and a rail, both of unique construction and shape. The concrete track bed is characterized by a plurality of panels, which may be either cast in place or pre-cast. Each panel has a pair of longitudinally extending rail supporting pedestals at either side thereof, with a connector extending between and connecting the pedestals to each other. Each of the pedestals is provided with a longitudinally extending slot. The rail has a head, and depending stem or web extending from the underside of the head, this being a terminal stem or web, since there is no flange or the like at the lower end of the stem or web of the rail. In addition, there is provided an outstanding flange at the lower portion of each side of the head, the flange extending outwardly from the lower portion or side of the head. The stem or web extends into the slot in the pedestal, and an anchoring system engages the flanges of the rail to hold the rail in position.

The above described rail and concrete bed panel construction are intended to replace substantial amounts of existing rail bed which has become unsatisfactory due to wear, erosion, settling and other causes. In some instances, however, it will be desirable to leave in place existing rail beds, including the conventional ties, rails and anchoring system, usually comprising spikes driven into the wooden ties. As is known, conventional rails have a head, a depending web, and a terminal transverse flange at the lower end of the web.

Where a pair of rails has been joined or connected, in the prior art, these have been rails of the same shape in cross section. Typically, there have been provided splice plates, being generally a pair of rectangular plates, either one or two of which may be positioned so as to overlap the ends of a pair of abutting rails. Fastening members, such as bolts and nuts are then used, the bolts passing through holes in these plates and the web of the rails, in order to secure the splice plates to the two rails.

SUMMARY OF THE INVENTION

A joint bar is provided for joining or connecting a conventional rail, having a head, a depending web and a lower transverse flange, and a non-conventional rail having a head and a depending terminal web. The joint bar has a first portion which is U-shaped, having a pair of vertical, spaced and parallel upstanding legs, joined by a lower bight. A second portion of the joint bar comprises a pair of spaced, parallel longitudinally extending elements, each extending from a leg of the first, U-shaped portion. Each of the elements of the second portion has an upper bulbous head, a lower flange, extending generally transversely, and a connecting web between the head and the flange. The U-shaped first portion of the joint provides a slot which receives the depending terminal web of the rail having a head and a terminal, depending web. The second portion of the joint bar receives between the two elements thereof the web of the conventional rail, which includes a head, depending web and transverse flange. The bulbous heads of the elements of the second portion of the joint bar engage beneath the head of the rail, and the flanges of the second portion elements engage the transverse flanges of the rail. Fastening elements, such as bolts and nuts, extend through holes in the legs of the U-shaped first portion of the joint bar, and through the web of the rail web therein, to secure the joint bar to that rail, and similar fastening or connecting elements extend through the webs of the elements and of the second rail.

Among the objects of the present invention are to provide a joint bar for connecting a conventional and a non-conventional generally T-shaped rail, and a further object is to provide a connecting joint bar which will function as a bridge for carrying the said T-rail out from a concrete rail pedestal sufficiently far to be able to have exposure of the stem of the T bar for attachment of the joint bar.

A further object of the present invention is to provide a joint bar construction which will function as a stiffener to allow the conventional rail to bear on the end of the concrete of the concrete track panel.

BRIEF DESCRIPTION OF THE DRAWING

FIG. 1 is a plan view of a railroad bed and tracks, at the juncture of conventional railroad bed and a novel bed.

FIG. 2 is a cross sectional view taken on the line 2—2 of FIG. 1.

FIG. 3 is an elevational view along the line 3—3 of FIG. 1.

Description of the Preferred Embodiment

Figure 4:
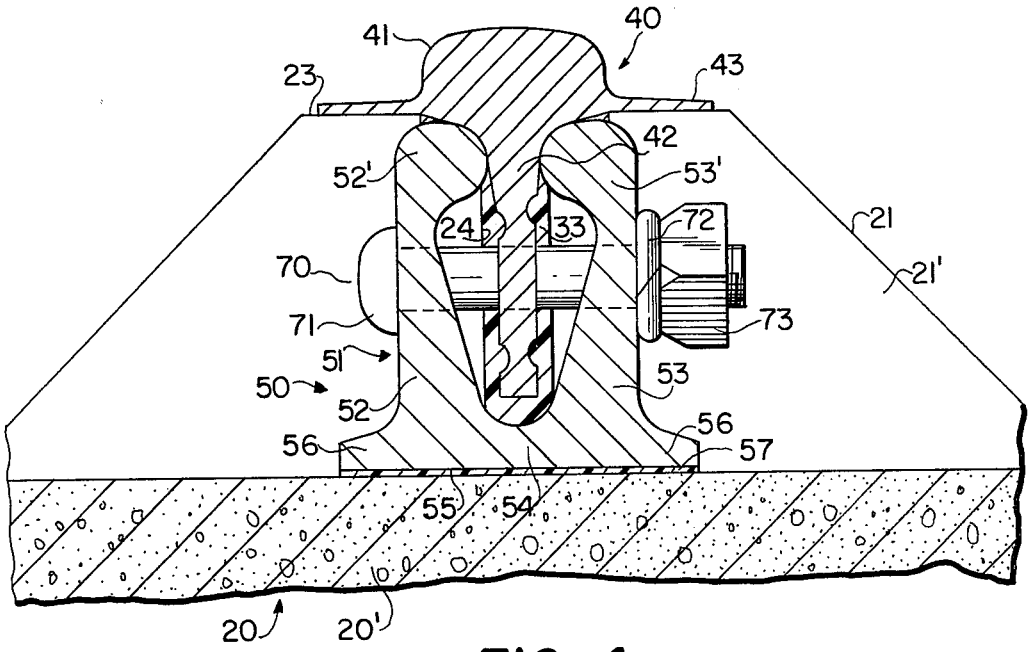
FIG. 4 is a cross sectional view taken on the line 4—4 of FIG. 3, and looking in the direction of the arrows.

Referring now to FIG. 1, there is shown a section of a conventional rail bed, generally designated 10, and including a plurality of spaced ties 11, plates 12 resting on the ties 11, and a pair of rails 13. To the left in FIG. 1 there is shown a concrete rail bed generally designated 20. The rail bed 20 comprises a plurality of panels, there being shown only a portion of a single panel in FIG. 1. Each of the panels has a pair of spaced, longitudinally extending rail supporting pedestals 21, with a plurality of connectors 22 extending between and connecting the pedestals 21.

In FIG. 2, there is shown the cross sectional shape of the pre-cast concrete panel bed 20. Thus there are shown a pair of spaced, longitudinally extending pedestals 21 at each side of the panel 20. There may also be seen the connector 22 extending between and connecting the pedestals 21. The connectors 22 extend transversely between the pedestals 21, and it will be observed that each of the pedestals 21 has a longitudinal and generally horizontal top surface 23, with a slot 24 extending into the pedestal 21 from the top surface thereof. The slot 24 terminates within the pedestal 21. At the sides of the top surface 23 there are an outer downwardly sloping shoulder **25*a* and an inner downwardly sloping shoulder 25*b*. An outer wall 26, preferably vertical, provides the outer boundary of the pedestal 21, and is connected by an arcuate surface 27 to a flat, horizontal bottom support surface 28. The support surface 28 is connected by an arcuate surface 29 to an upwardly and inwardly sloping surface 31. This is joined by an arcuate portion 32 to the downwardly and outwardly sloping surface or shoulder 25***b*.

A generally T-shaped rail 40 is provided, supported by each of the rail support pedestals 21. Each of the rails 40 comprises a head 41, a depending terminal stem or web 42, and a pair of flanges 43 which extend generally horizontally outwardly from the lower portion of the side of the head 41 of rail 40. The web or stem 42 extends into the slot 24 of the rail supporting pedestal 21, and the flanges 43 overlie and extend above the horizontal surface 23.

Referring again to FIG. 1, there may be seen the end of the rail pedestals 21, designated 21', which is formed as a sloping shoulder. Also shown in FIG. 1 is a joint bar 50, for connecting a rail 40 to a conventional rail 13.

Referring now to FIG. 3, there is shown the concrete track panel generally designated 20, with a large terminal connector plate portion 20', extending outwardly beyond the shoulder 21' which forms the terminus of the pedestal 21. The generally T-shaped rail 40 may be seen extending outwardly beyond the shoulder 21' of the pedestal 21, with the web 42 thereof extending out of the slot 24. There may be also seen the head 41, and an outstanding flange 43.

At the right of FIG. 3, there is shown the rail 13, which has a conventional head 14, a web 15, and a transversely extending flange 16. The connector 50 may be seen, connected to the web 42 and the web 15 by suitable fastening elements 70.

Referring now to FIG. 4, there may be seen the slab 20, with the connector plate portion 20', and the terminal shoulder 21' of the pedestal 21. The slot 24 in the pedestal 21 is shown, receiving therein the web 42 of generally T-shaped rail 40, which has the outstanding flanges 43. Elastomeric bedding material is shown within the slot 24, and is generally designated 33. The flange 43 may be seen to be resting on portions of the elastomeric material 33 underlying them, and spacing them from the top surface 23 of rail pedestal 21.

There is shown in FIG. 4 a first portion 51 of the joint bar 50, and comprising a pair of generally upstanding and parallel legs 52 and 53, which are spaced apart, and which are joined at their bottoms by a bight 54. The bight 54 is provided with a flat bottom surface 55, and has outstanding flanges 56. The legs 52 and 53 are provided at their ends with bulbous heads 52' and 53', which engage beneath the head 41 of the rail 40. Thereby, the rail 40, extending outwardly beyond the rail supporting pedestal 21, is carried by the first, U-shaped portion 51 of the joint bar 50, this portion 51 engaging the underside of the head 41 of rail 40, and transferring the weight of it and of rolling stock passing on it to the connector plate portion 20' of the concrete bed 20, through the bight portion 54, and flanges 56.

The web 42 of rail 40 and the legs 52 and 53 have apertures therein, through which the fastener 70 passes in order to secure the joint bar 50 to the end portion of the rail 40. The fastener element 70 comprises a bolt 71, lock washer 72 and nut 73.

Figure 5:
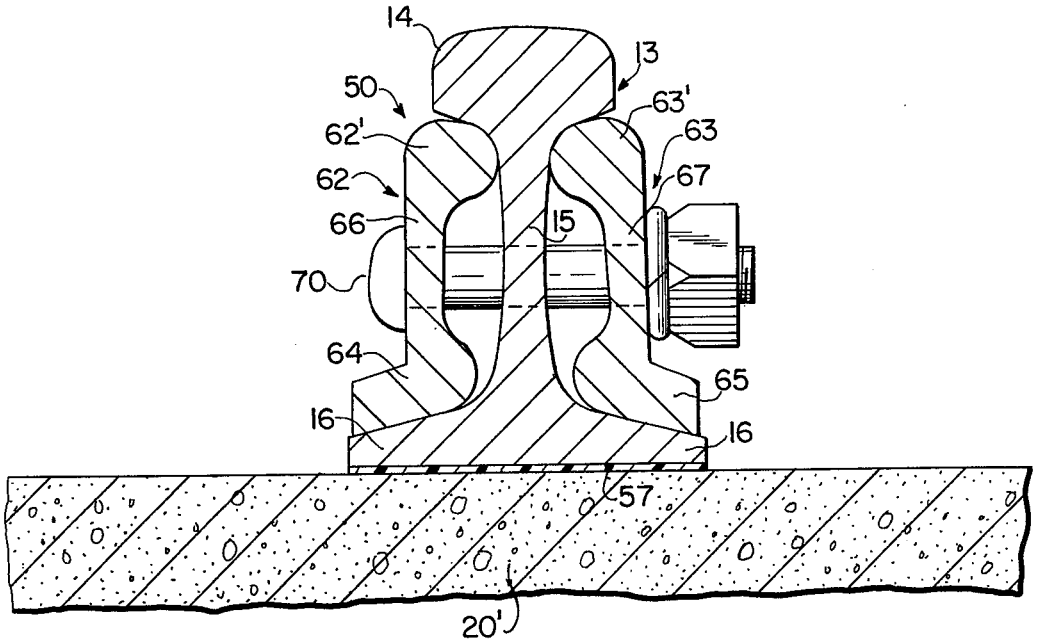
FIG. 5 is a cross sectional view taken on the line 5—5 of FIG. 3.

Referring now to FIG. 5, there may be seen the conventional rail 13 having a head 14, web 15, and a pair of transverse flanges 16 at the lower end of web 15. Also shown in FIG. 5 are a pair of spaced elements 62 and 63, which comprise the second portion of the joint bar 50. Each of the elements 62, 63 has an upper, bulbous head, 62', 63', a flange 64, 65 at the lower margin thereof, and a web 66, 67 connecting the upper bulbous head and the lower flange. A connector or fastener 70 is shown, passing through apertures in the web 15 and in the connecting webs 66 and 67, to secure the second portion 62 of the joint bar 50 to the conventional rail 13.

Referring again to FIG. 3, the joint bar 51 may be seen, including one leg of the first portion 51, and with the flange 56 of the first portion 51 resting on the connector plate portion 20'. A bed of elastomeric material 57 is preferably placed between the bottom of the flange 56 and the concrete connector plate 20'. There is indicated, also, the bulbous head 52' which engages on the underside of the head 41 of the rail 40. The second portion of the joint bar 50 is shown at the right hand part of FIG. 3, and there will be seen the flange 64 of the element 62 on the flange 16 of rail 13, which latter rests, also, on the elastomeric bed 57. In addition, the bulbous head 62' will be seen to underlie the head 14 of rail 13.

As may be seen from FIGS. 3, 4 and 5, the joint bar 50 serves to join or connect the rails 40 and 13, due to the fasteners 70 passing therethrough. Also, the joint bar 50 acts as a bridge structure to carry the T-rail 40 out from the rail pedestal 21, sufficiently far so that there is a sufficient amount of the stem or web 42 of rail 40 exposed to provide for attachment of joint bar 50 thereto. Thereby, the joint bar 50 acts as a stiffener and a bearing to carry the load of the rail 40, and also acts as a stiffener to allow conventional rail 13 to bear on the end of the concrete panel 20. The joint bar 50 is made of sufficient length so as to stiffen the rail 13 against abnormal bending, under the load of passing traffic, at least back to the first conventional tie 11.

It will be obvious to those skilled in the art that various changes may be made without departing from the spirit of the invention, and therefore the invention is not limited to what is shown in the drawings and described in the specification but only as indicated by the appended claims.

I claim:

1. In combination a first rail having a head for supporting the wheels of a train and a terminal depending web extending downwardly from said head, a second rail having a head, a web extending downwardly therefrom and a transverse flange at the lower end of said web, and a joint bar comprising a first, substantially U-shaped portion having a bight at the bottom thereof and a pair of legs, and a second portion having a pair of spaced elements extending longitudinally of said first portion, one from each of said legs, said first rail being carried only by said first portion and said second rail being secured only between the spaced elements of said second portion.

2. The combination of claim 1, said joint bar having said first portion secured to said first rail and having means for engaging an underlying support, and said second portion having means supportingly engaging the underside of said head of said second rail.

3. The combination of claim 2, said second portion further comprising means engaging the top of said transverse flange.

4. The combination of claim 3, said second portion comprising a web extending between said means engaging said head and said flange.

5. The combination of claim 1, including fastening means extending through said U-shaped portion and said web of said first rail, and flange means on said first portion for engaging an underlying support.

6. A joint bar for joining a first rail having a head and a terminal depending web and a second rail having a head, a depending web and a transverse flange, said joint bar comprising:

a first, U-shaped portion having a bight at the bottom thereof and a pair of legs, the U-shaped portion being adapted to carry only the first rail, and a pair of spaced elements extending longitudinally of said first portion, one from each of said legs, said pair of elements being adapted to receive only the second rail therebetween.

7. A joint bar as set forth in claim 6, said spaced elements each comprising an upper bulbous head.

8. A joint bar as set forth in claim 6, said spaced elements each comprising a flange at the lower margin thereof.

9. A joint bar as set forth in claim 8, said spaced elements each comprising an upper bulbous head.

10. A joint bar as set forh in claim 9, and a web connecting said head and said flange.

11. A joint bar as set forth in claim 6, said legs of said U-shaped portion having bulbous upper ends.

12. A joint bar as set forth in claim 6, said first portion having an outwardly extending flange adjacent the bight.

* * * * *